US008739327B2

(12) United States Patent
Hsu et al.

(10) Patent No.: US 8,739,327 B2
(45) Date of Patent: Jun. 3, 2014

(54) SINGLE HANDLE FAUCET AND A CONNECTING STRUCTURE THEREOF

(75) Inventors: Weimien Hsu, Taichung (TW); Chunhung Li, Taichung (TW); Yongium Wu, Shen Zen (CN); Xiaomao Tang, Shen Zen (CN)

(73) Assignee: Globe Union Industrial Corp., Taichung (TW)

( * ) Notice: Subject to any disclaimer, the term of this patent is extended or adjusted under 35 U.S.C. 154(b) by 506 days.

(21) Appl. No.: 13/215,104

(22) Filed: Aug. 22, 2011

(65) Prior Publication Data

US 2013/0048122 A1 Feb. 28, 2013

(51) Int. Cl.
*E03C 1/04* (2006.01)

(52) U.S. Cl.
USPC ..... 4/677

(58) Field of Classification Search
CPC ..... E03C 1/00
USPC ..... 4/675–678
See application file for complete search history.

(56) References Cited

U.S. PATENT DOCUMENTS 7,296,588 B1 * 11/2007 Hwang ..... 137/359
8,375,993 B2 * 2/2013 Esche et al. ..... 137/801
8,439,076 B2 * 5/2013 Lin ..... 137/801

* cited by examiner

*Primary Examiner* — Lori Baker

(57) ABSTRACT

A single handle faucet is fixed on a basin with a first hole and two second holes and contains a body; a control valve set fixed on the body and including a handle located above a central position of the body to rotate the valve core; two inlet pipes connected with the control valve set to feed cold water and hot water individually and extending out of the first hole of the basin; an outlet pipe coupled with the control valve set to flow mixed water of the cold water and the hot water; two screw rods including two top ends to connect with two sides of the housing individually and two bottom ends extending out of the two second holes respectively; two nuts screwed with the two screw rods respectively and engaged with a bottom end of the basin so that the faucet is locked on the basin.

8 Claims, 7 Drawing Sheets

SINGLE HANDLE FAUCET AND A CONNECTING STRUCTURE THEREOF

BACKGROUND OF THE INVENTION

1. Field of the Invention

The present invention relates to a single handle faucet and a connecting structure thereof.

2. Description of the Prior Art

With reference to FIG. 1, a conventional single-handle lavatory faucet 2 (such as the 4" centerset lavatory faucet) is fixed on a basin 1 with three holes 5 and includes two twisted inlet pipes 3 connected with a holder to feed cold water and hot water respectively and extending out of two of the three holes 5 located at two sides of the basin 1 individually with two screw rods 4, thereafter the two screw rods 4 are screwed with two nuts 6 respectively so that the faucet 2 is fixed on the basin 1. To prevent the nuts 6 from being stopped by the inlet pipes 3 proximate to the screw rods 4, the nuts 6 with smaller size have to be applied, and a bushing 7 and an elongated press plate 8 are fitted onto each screw rod 4, then the nuts 6 and the screw rods 4 are screwed together so that the bushing 7 and the press plate 8 engage with a bottom end of the basin 1 securely, thus connecting the faucet 2 with the basin 1.

However, the nuts 6 and the screw rods 4 are fixed below the basin 1 and are close to a wall, therefore an operating space is limited. Moreover, the screw rods 4 are close to the inlet pipes 3 to operate a tool within a limited space and are interfered by the inlet pipes 3, fixing the faucet 2 difficulty. Likewise, the size of the nuts 6 are limited without using a larger size of nuts, and a larger lever arm can not be provided, so a user can not operate the nut manually but has to use a rotating tool.

The present invention has arisen to mitigate and/or obviate the afore-described disadvantages.

SUMMARY OF THE INVENTION

The primary object of the present invention is to provide a single handle faucet which is capable of overcoming the shortcomings of the conventional single handle faucet.

To obtain the above objectives, a single handle faucet being fixed on a basin with a first hole located at a central position thereof and two second holes disposed on two sides thereof respectively and comprising:

a body;

a control valve set fixed on the body and including a handle located above a central position of the body to rotate a valve core;

two inlet pipes connected with the control valve set to feed cold water and hot water individually and extending out of the first hole of the basin;

an outlet pipe coupled with the control valve set to flow mixed water of the cold water and the hot water;

two screw rods including two top ends to connect with two sides of the body individually and two bottom ends extending out of the two second holes of the basin respectively;

two nuts screwed with the two screw rods respectively and engaged with a bottom end of the basin so that the faucet is locked on the basin;

wherein each of the two nuts includes an orifice formed on a central position thereof to screw with each of the two screw rods, a disk portion arranged on a top end thereof, an abutting wall extending from a peripheral side of the disk portion and having a diameter more than that of the second hole to retain with the second hole of the basin, a groove disposed in the disk portion, and an arcuate guiding wall fixed on a central position of the groove and extending toward the orifice so that the screw rod slides into the guiding wall to screw with the orifice; the disk portion includes two wings extending outward from two sides of a bottom end thereof respectively to be manually rotated by a user.

Another object of the present invention is to provide a connecting structure of a single handle faucet which is capable of overcoming the shortcomings of the conventional connecting structure of a single handle faucet.

To obtain the above objective, a connecting structure of a single handle faucet is fixed on a basin with a first hole located at a central position thereof and two second holes disposed on two sides thereof respectively and contains:

a basin including a first hole located at a central position thereof and two second holes disposed on two sides thereof respectively;

a faucet includes a body, a control valve set, two inlet pipes, an outlet pipe, two screw rods, and two nuts; wherein the control valve set is fixed on the body and includes a handle located above a central position of the body;

the two inlet pipes are connected with the control valve set to feed cold water and hot water individually and extend out of the first hole of the basin;

the outlet pipe is coupled with the control valve set to flow mixed water of the cold water and the hot water;

the two screw rods include two top ends to connect with two sides of the body individually and two bottom ends extending out of the two second holes of the basin respectively;

the two nuts screwed with the two screw rods respectively and engaged with a bottom end of the basin so that the faucet is locked on the basin;

wherein each of the two nuts includes an orifice formed on a central position thereof to screw with each of the two screw rods, a disk portion arranged on a top end thereof, an abutting wall extending from a peripheral side of the disk portion and having a diameter more than that of the second hole to retain with a second hole of the basin, a groove disposed in the disk portion, and an arcuate guiding wall fixed on a central position of the groove and extending toward the orifice so that the screw rod slides into the guiding wall to screw with the orifice; the disk portion includes two wings extending outward from two sides of a bottom end thereof respectively to be manually rotated by a user.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 4:
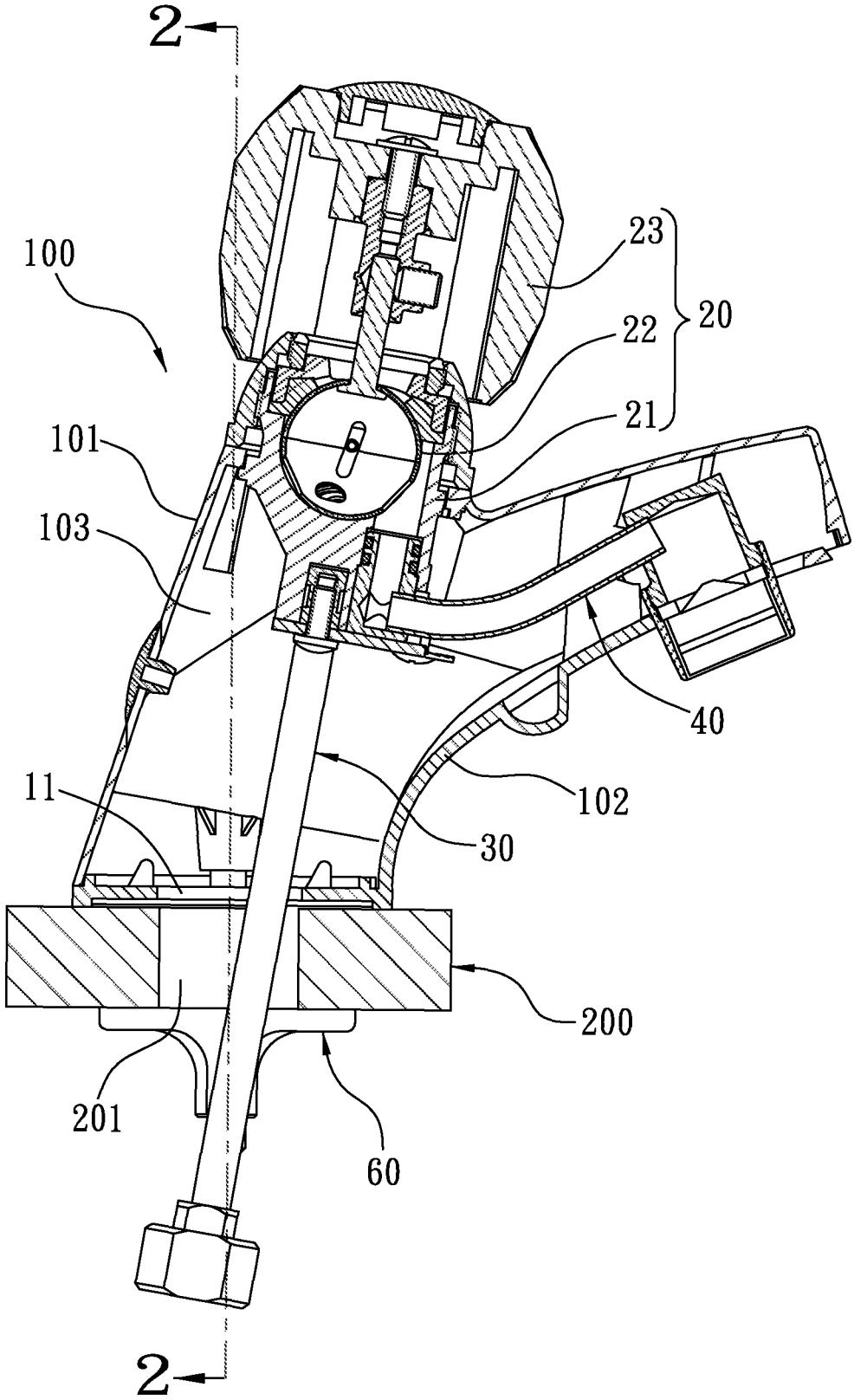
FIG. 4 is cross sectional view taken along the line 1-1 of FIG. 3.
Figure 5:
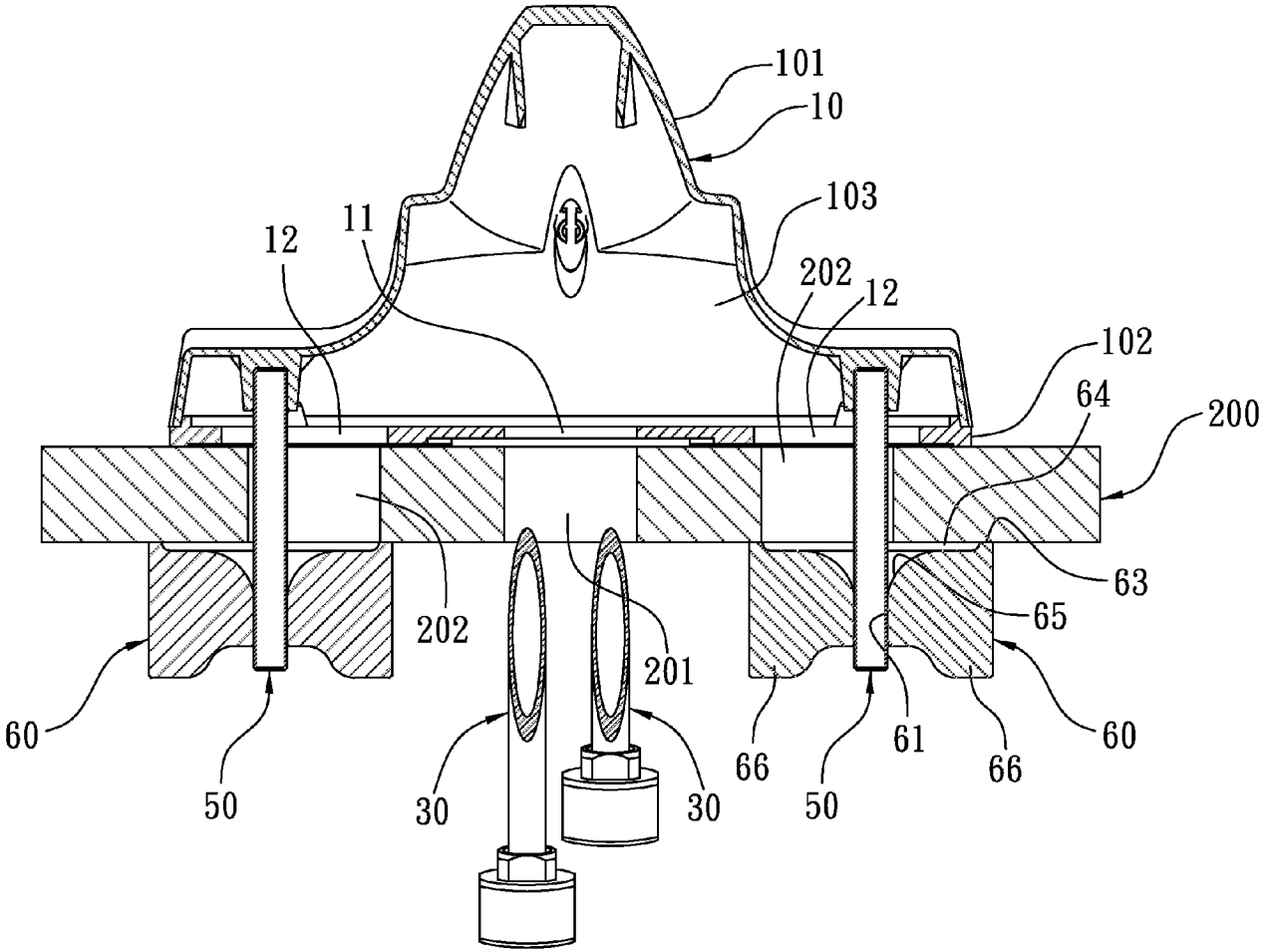
FIG. 5 is cross sectional view taken along the line 2-2 of FIG. 4.
Figure 6:
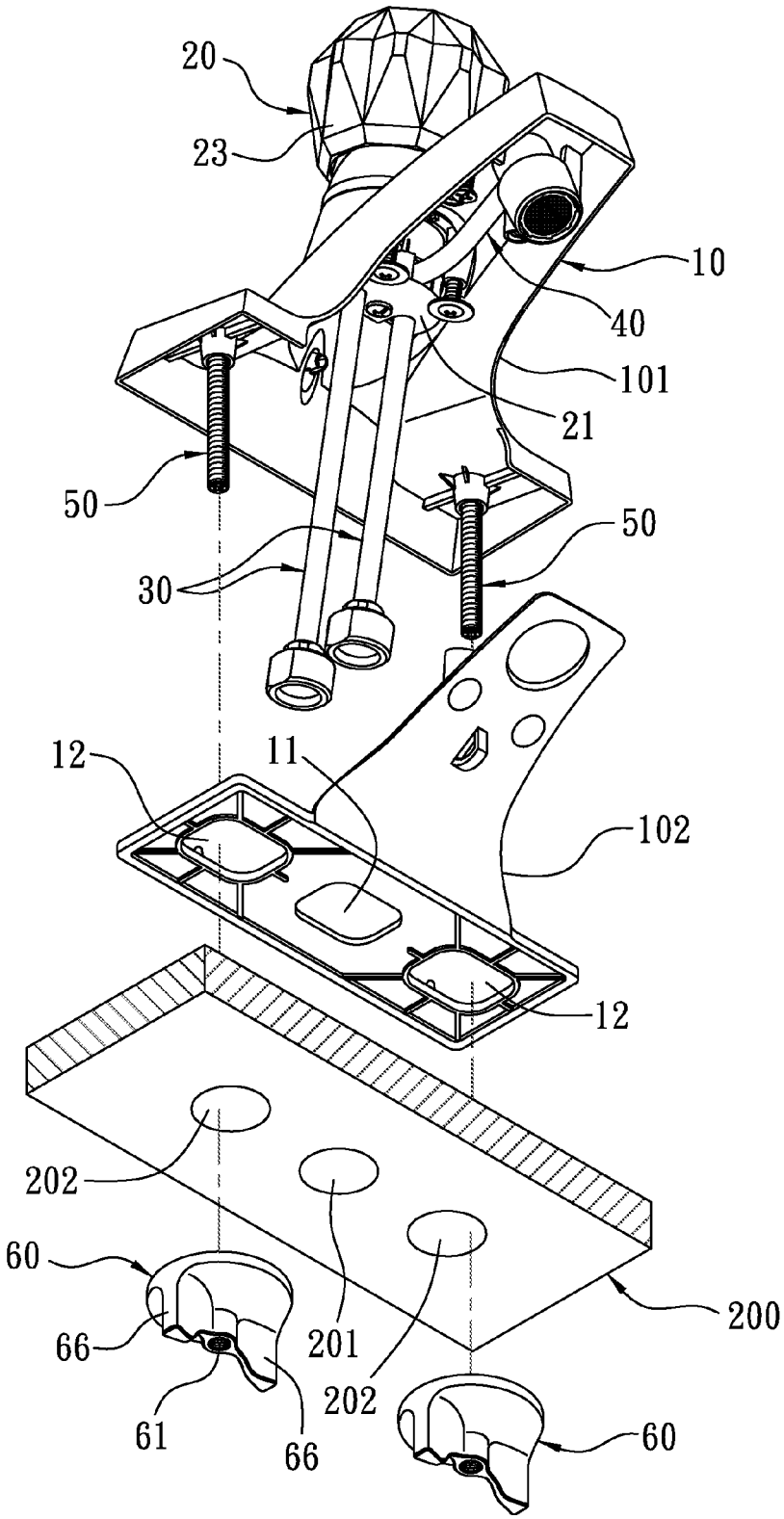
FIG. 6 is a perspective view showing the exploded components of the faucet and the basin according to the first embodiment of the present invention.

Referring to FIGS. 2-5, a single handle faucet 100 according to a preferred embodiment of the present invention is used as a single-handle lavatory faucet (such as 4" centerset lavatory faucet) and fixed on a basin 200, the basin 200 includes a first hole 201 located at a central position thereof as shown in FIG. 6 and two second holes 202 disposed on two sides thereof respectively, wherein a diameter and a spaced distance of the first hole 201 and the second hole 202 are limited by a standard specification individually.

The faucet 100 includes a body 10, a control valve set 20, two inlet pipes 30, an outlet pipe 40, two screw rods 50, and two nuts 60.

The body 10 includes a housing 101 and a seat 102 as illustrated in FIG. 6, and a chamber 103 defined between the housing 101 and the seat 102 to receive the control valve set 20, the two inlet pipes 30, and the two outlet pipes 40, the seat 102 includes a first aperture 11 located at a central position thereof and two second apertures 12 fixed at two sides thereof respectively.

The control valve set 20 is a well-know structure and is fixed on the body 10. The control valve set 20 includes a holder 21 fixed in the chamber 103 of the body 10, a valve core 22 secured in the holder 21, and a handle 23 to rotate the valve core 22; the handle 23 is located above a central position of the body 10.

Figure 1:
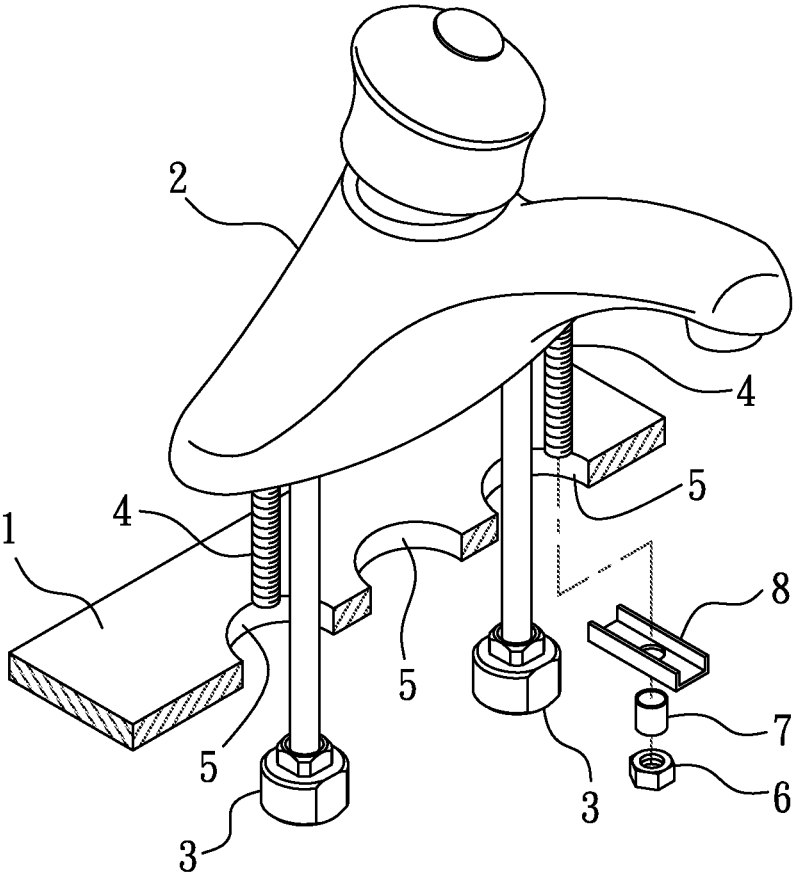
Fig. 1 Prior Art
FIG. 1 is a cross-sectional perspective view showing the assembly of a conventional faucet being connected with a basin.
Figure 2:
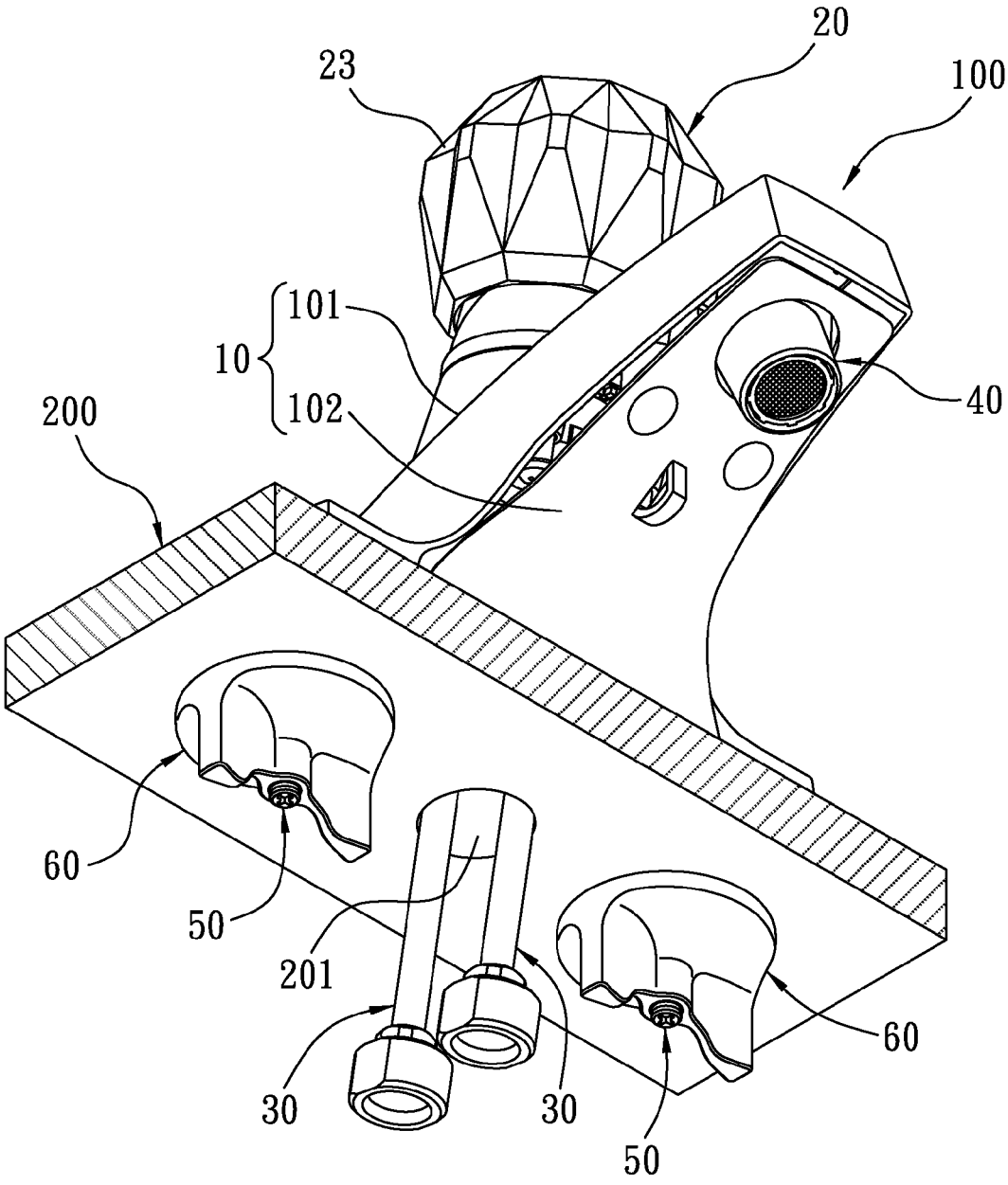
FIG. 2 is a cross-sectional perspective view showing the assembly of a faucet and a basin according to a preferred embodiment of the present invention.
Figure 3:
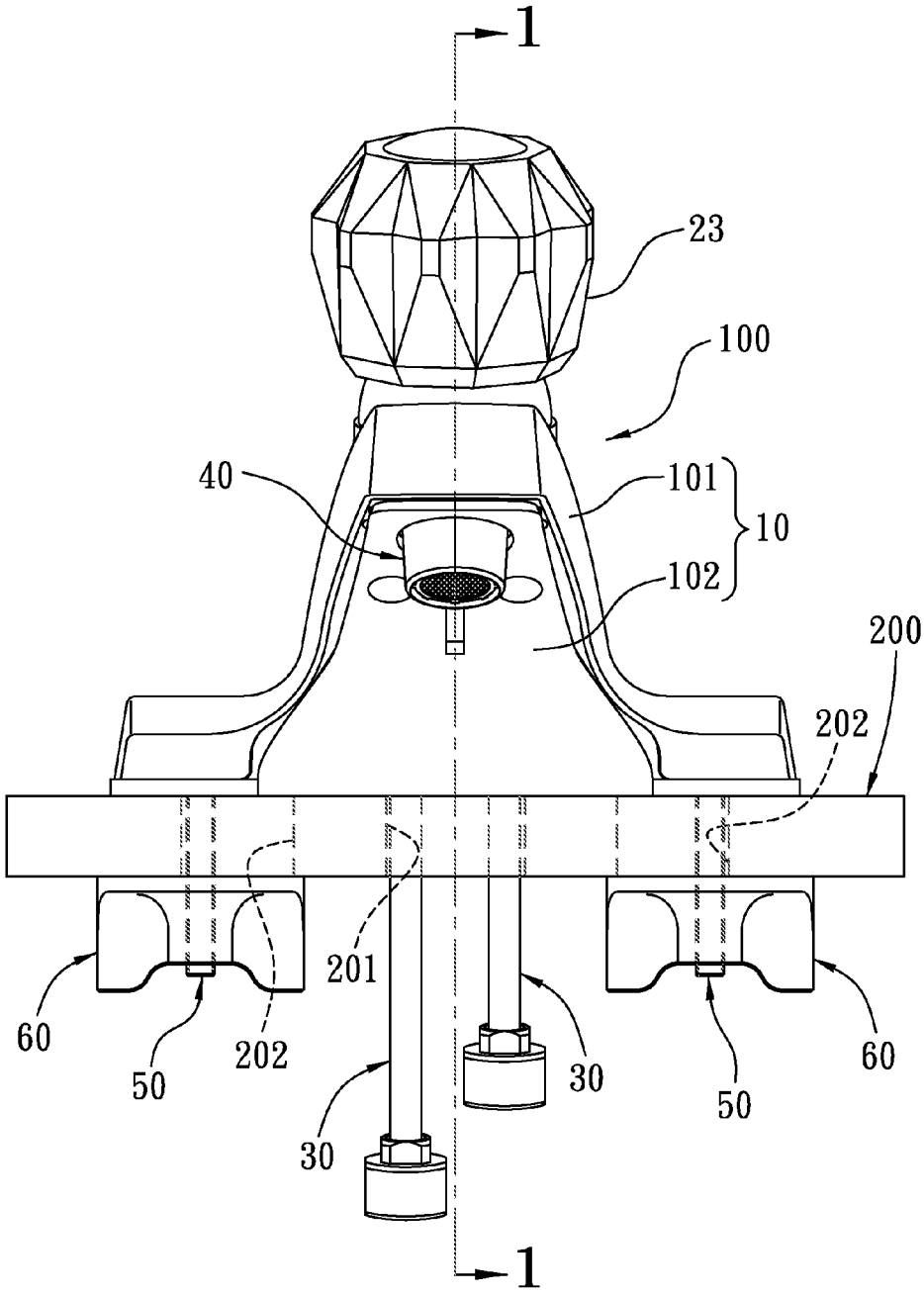
FIG. 3 is a front plan view showing the assembly of the faucet according to the preferred embodiment of the present invention.

The two inlet pipes 30 are connected with the control valve set 20 to feed cold water and hot water individually and extend out of the first aperture 11 of the seat 102 and the first hole 201 of the basin 200 respectively along the control valve assembly 20, as shown in FIGS. 2 and 4.

The outlet pipe 40 is coupled with the control valve set 20 to flow mixed water of the cold water and the hot water.

The two screw rods 50 include two top ends to connect with two bottom ends of two sides of the housing 101 individually as illustrated in FIG. 6 and two bottom ends extending out of the second apertures 12 of the seat 102 and the two second holes 202 of the basin 200 respectively as shown in FIG. 5.

Figure 7:
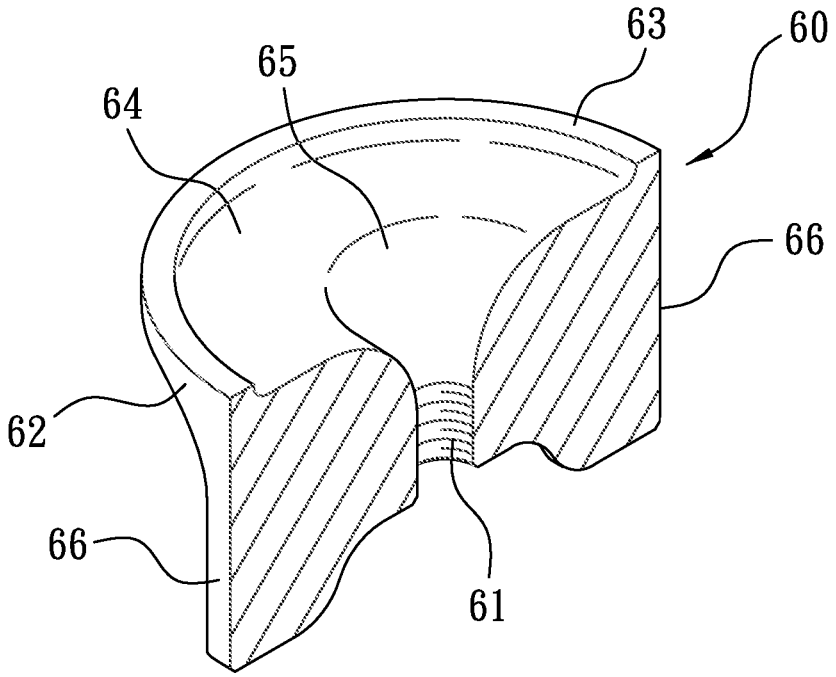
FIG. 7 is a cross-sectional perspective view showing the assembly of a nut according to the preferred embodiment of the present invention.

The nuts 60 are screwed with the two screw rods 50 respectively and engaged with a bottom end of the basin 200 so that the faucet 100 is locked on the basin 200 as shown in FIG. 5. Each of the two nuts 60 includes an orifice 61 formed on a central position thereof to screw with each of the two screw rods 50 as illustrated in FIG. 7, a disk portion 62 arranged on a top end thereof, an abutting wall 63 extending from a peripheral side of the disk portion 62 and having a diameter more than that of the second hole 202 to retain with the second hole 202, a groove 64 disposed in the disk portion 62, and an arcuate guiding wall 65 fixed on a central position of the groove 64 and extending toward the orifice 61 so that the bottom end of the screw rod 50 slides into the guiding wall 65 to screw with the orifice 61; the disk portion 62 includes two wings 66 extending outward from two sides of a bottom end thereof respectively to be manually rotated by a user easily.

Because the diameter and the spaced distance of the first hole 201 and the second hole 202 are limited by the standard specification individually, a centrally axial line of the inlet pipe 30 is limited within 20 to 33 mm so that the inlet pipe 30 is inserted through the first aperture 11 of the seat 102 and the first hole 201 of the basin 200. Also, a centrally axial line of any one of the inlet pipes 30 and the screw rods 50 is capable of being limited within 30 to 85 mm so that the screw rod 50 is inserted through the second aperture 12 of the seat 102 and the second hole 202 of the basin 200.

Before an installation of the faucet 100, the two inlet pipes 30 and the two screw rods 50 are fixed on the holder 21 of the control valve set 20 and the housing 101 of the body 10, as illustrated in FIG. 6, and during the installation of the faucet 100, the two inlet pipes 30 are aligned with the first hole 201 of the basin 200, and the two screw rods 50 are aligned with the two second holes 202 individually, thereafter the two inlet pipes 30 are inserted through the first hole 201 and the two screw rods 50 are inserted through the two second holes 202 to screw with the nuts 60 respectively until the abutting wall 63 of the disk portion 62 engages with the bottom end of the basin 200 as illustrated in FIG. 5, thus connecting the faucet 100 with the basin 200.

Thereby, the inserting positions of the inlet pipes 30 and the screw rods 50 are spaced apart from each other, i.e., the two inlet pipes 30 are inserted through the first hole 201 to space apart the two screw rods 50 which are inserted through the two second holes 202 individually so that a larger space around the screw rod 50 is formed, hence the nuts 60 are screwed with the screw rods 50 easily so that the faucet 100 is connected with the basin 200 quickly.

Due to the two inlet pipes 30 are spaced apart from the two screw rods 50, an enough space is obtained to rotate the nut 60 with a larger size so that when the screw rod 50 is screwed with the nut 60, the abutting wall 63 engages with the bottom end of the basin 200 without using a bushing and a press plate, thus decreasing connecting components to save installation cost.

Because a larger size of the nut 60 is applied to connect the faucet 100 with the basin 200, a larger lever arm generates on the nut 60 so that the nut 60 is manually rotated by the user. Furthermore, the two wings 66 are formed on the two sides of the disk portion 62 to generate the larger lever arm so that the wings 66 are rotated by the user's fingers to rotate the nut 60 easily, thereby manually fixing and removing the faucet 100 without using any tool.

While we have shown and described various embodiments in accordance with the present invention, it is clear to those skilled in the art that further embodiments may be made without departing from the scope of the present invention.

What is claimed is:

1. A single handle faucet being fixed on a basin with a first hole located at a central position thereof and two second holes disposed on two sides thereof respectively and comprising:

a body;

a control valve set fixed on the body and including a handle located above a central position of the body to rotate a valve core;

two inlet pipes connected with the control valve set to feed cold water and hot water individually and extending out of the first hole of the basin;

an outlet pipe coupled with the control valve set to flow mixed water of the cold water and the hot water;

two screw rods including two top ends to connect with two sides of the body individually and two bottom ends extending out of the two second holes of the basin respectively;

two nuts screwed with the two screw rods respectively and engaged with a bottom end of the basin so that the faucet is locked on the basin;

wherein each of the two nuts includes an orifice formed on a central position thereof to screw with each of the two screw rods, a disk portion arranged on a top end thereof, an abutting wall extending from a peripheral side of the disk portion and having a diameter more than that of the second hole to retain with the second hole of the basin, a groove disposed in the disk portion, and an arcuate guiding wall fixed on a central position of the groove and extending toward the orifice so that the screw rod slides into the guiding wall to screw with the orifice; the disk portion includes two wings extending outward from two sides of a bottom end thereof respectively to be manually rotated by a user.

2. The single handle faucet as claimed in claim 1, wherein a centrally axial line of each of the two inlet pipes is limited within 20 to 33 mm.

3. The single handle faucet as claimed in claim 1, wherein a centrally axial line of any one of the inlet pipes and the screw rods is capable of being limited within 30 to 85 mm.

4. The single handle faucet as claimed in claim 1, wherein the body includes a housing and a seat, and a chamber defined between the housing and the seat to receive the control valve set, the two inlet pipes, and the two outlet pipes; the seat includes a first aperture located at a central position thereof to insert the outlet pipes and two second apertures fixed at two sides thereof to insert the screw rods respectively; the two top ends of the two screw rods are connected with two bottom ends of two sides of the housing individually.

5. The connecting structure of a single handle faucet comprising:

a basin including a first hole located at a central position thereof and two second holes disposed on two sides thereof respectively;

a faucet includes a body, a control valve set, two inlet pipes, an outlet pipe, two screw rods, and two nuts; wherein the control valve set is fixed on the body and includes a handle located above a central position of the body;

the two inlet pipes are connected with the control valve set to feed cold water and hot water individually and extend out of the first hole of the basin;

the outlet pipe is coupled with the control valve set to flow mixed water of the cold water and the hot water;

the two screw rods include two top ends to connect with two sides of the body individually and two bottom ends extending out of the two second holes of the basin respectively;

the two nuts screwed with the two screw rods respectively and engaged with a bottom end of the basin so that the faucet is locked on the basin;

wherein each of the two nuts includes an orifice formed on a central position thereof to screw with each of the two screw rods, a disk portion arranged on a top end thereof, an abutting wall extending from a peripheral side of the disk portion and having a diameter more than that of the second hole to retain with the second hole of the basin, a groove disposed in the disk portion, and an arcuate guiding wall fixed on a central position of the groove and extending toward the orifice so that the screw rod slides into the guiding wall to screw with the orifice; the disk portion includes two wings extending outward from two sides of a bottom end thereof respectively to be manually rotated by a user.

6. The connecting structure for the faucet as claimed in claim 5, wherein a centrally axial line of each of the two inlet pipes is limited within 20 to 33 mm.

7. The connecting structure for the faucet as claimed in claim 5, wherein a centrally axial line of any one of the inlet pipes and the screw rods is limited within 30 to 85 mm.

8. The connecting structure for the faucet as claimed in claim 5, wherein the body includes a housing and a seat, and a chamber defined between the housing and the seat to receive the control valve set, the two inlet pipes, and the two outlet pipes; the seat includes a first aperture located at a central position thereof to insert the outlet pipes and two second apertures fixed at two sides thereof to insert the screw rods respectively; the two top ends of the two screw rods are connected with two bottom ends of two sides of the housing individually.

* * * * *